US006435482B1

(12) United States Patent
Omi et al.

(10) Patent No.: US 6,435,482 B1
(45) Date of Patent: Aug. 20, 2002

(54) CARBURETOR FOR A GENERAL PURPOSE ENGINE

(75) Inventors: Masaaki Omi; Wataru Takahashi, both of Atsugi (JP)

(73) Assignee: Nippon Carburetor Co., Ltd., Kanagawa (JP)

( * ) Notice: Subject to any disclaimer, the term of this patent is extended or adjusted under 35 U.S.C. 154(b) by 0 days.

(21) Appl. No.: 09/616,497

(22) Filed: Jul. 13, 2000

(30) Foreign Application Priority Data

Jul. 16, 1999 (JP) ..... 11-202471
Jul. 16, 1999 (JP) ..... 11-202472

(51) Int. Cl.[7] ..... F02M 5/12
(52) U.S. Cl. ..... 261/70; 261/72.1; 261/DIG. 39
(58) Field of Search ..... 261/69.1, 70, 72.1, 261/72.2, DIG. 39, DIG. 67

(56) References Cited

U.S. PATENT DOCUMENTS 3,188,060 A * 6/1965 Kalert, Jr. ..... 261/23.2
3,215,413 A * 11/1965 Szwargulski et al. .. 261/69.1 X
3,307,839 A * 3/1967 Berzlapa ..... 261/69.1 X
3,342,463 A * 9/1967 Date et al. ..... 261/69.1 X
3,730,493 A * 5/1973 Elam ..... 261/70 X
3,780,996 A * 12/1973 Nutten ..... 261/72.1
3,963,809 A * 6/1976 Steiner ..... 261/69.1
4,046,844 A * 9/1977 Rickert ..... 261/DIG. 39
4,111,176 A * 9/1978 Fenton et al. ..... 261/DIG. 67
4,246,875 A * 1/1981 Bier et al. ..... 261/69.1 X
4,254,064 A * 3/1981 Bernauer et al. ..... 261/72.1 X
4,404,151 A 9/1983 Inkpen et al. ..... 261/44.4
4,405,151 A 9/1983 Inkpen et al. ..... 261/44.4
4,496,449 A * 1/1985 Satoh ..... 261/72.1 X
4,913,855 A * 4/1990 Panzica ..... 261/72.1 X
5,049,318 A * 9/1991 Guntly et al. ..... 261/72.1 X

FOREIGN PATENT DOCUMENTS

JP 33-6709 5/1958
JP 49-39710 * 10/1974
JP 56-501207 8/1981
JP 62-59226 12/1987
JP 62-61783 12/1987

* cited by examiner

*Primary Examiner*—Richard L. Chiesa
(74) *Attorney, Agent, or Firm*—Baker Botts L.L.P.

(57) ABSTRACT

A carburetor for a general purpose engine is structured by a carburetor barrel body having an air horn which is made of metal so as to have an ensured mechanical strength, a constant level fuel bowl coupled to the carburetor barrel body, and a fuel trunk with fuel wells and passageways leading to the air horn from the wells which is made of synthetic resin separately from the carburetor barrel body and installed so as to extend into the fuel bowl from the carburetor barrel body. The carburetor prevents or significantly reduces evaporation of fuel in the wells during an engine stop and also prevents or significantly reduces evaporation of fuel introduced into the fuel bowl at an engine restart even if the fuel in the wells evaporates, with an effect of improving performance of restarting the engine at high temperatures.

20 Claims, 8 Drawing Sheets

CARBURETOR FOR A GENERAL PURPOSE ENGINE

BACKGROUND OF THE INVENTION

1. Field of the Invention

The present invention relates to a carburetor for a general purpose internal combustion engine, and, more particularly, to a carburetor for a general purpose engine which is prominent in restarting he engine at high temperatures.

2. Description of the Related Art

In recent days of automobiles, in order for automobile engines to achieve fulfillment of regulations on emissions or a strong demand for lowering levels of emissions, it has been employed to burn a fuel mixture as lean as possible. On these grounds, the temperature of fuel combustion is set rather on the higher side for the lean burn internal combustion engine as compared to the conventional internal combustion engines. A soundproofing type of automobile engine that is surrounded by a sound insulation wall to lower a level of sound is lacking in heat dissipation capacity in a constructional point of view, which makes it hardly avoidable that the engine remains hot for a relatively long period of time after an engine stop.

On the other hand, a carburetor, that is used to mix fuel and air in correct proportions, generally has an aluminum die-cast barrel body. The carburetor barrel body is formed with various bores used as passageways including fuel passages and bleed air passages which form part of carburetor circuits for performing specific functions. Almost of all of the passages are drilled excepting bores formed by the use of pin extraction. The carburetor barrel body is a die-cast product of aluminum, an excellent heat conductive material, is connected to an intake manifold of the engine, and is heated by a high combustion temperature of the engine and easily gets a high temperature as a whole and, in consequence, in particular in the case where the carburetor is installed to the sound proofing type of engine, remains at a high temperature for a long period of time after an engine stop. In this condition, fuel in a fuel well of a main fuel supply passage (main carburetor circuit) evaporates in a period of engine stop. The engine is possibly forced to restart without supply of fuel into an air passage, namely, an air horn, in particular, in the case where the carburetor is equipped with means for closing a fuel inlet port when the engine stops as a countermeasure to dieseling or running-on, which is a condition in which an engine continues to run after the ignition key is turned off. Furthermore, when restarting the engine at high temperatures, fuel evaporates as soon as it is introduced into the fuel well, which is always one of various causes for difficulties in high temperature engine starting. One of some typical countermeasures against the difficulty is installation of a heat insulation gasket between the carburetor barrel body and the intake manifold. Another countermeasure is to construct a carburetor made up of a carburetor barrel body formed with fuel and air passages and a fuel bowl (fuel container) for providing a constant level fuel chamber therein which are made of high heat conductive materials such as known from, for example, Japanese Utility Model Publication No. 49-39710.

Although heat insulation gaskets are effective in the insulation of heat that is transferred to the carburetor barrel body from the engine through the intake manifold, they are incapable of preventing the carburetor barrel body from direct exposure to high temperature heat radiation heat from, in particular, the soundproofing type engine, so as to have no effect of reducing the difficulty of high temperature restarting. The carburetor that is made up of synthetic resin molding products, namely, a synthetic resin molding carburetor barrel body and a synthetic resin molding fuel bowl, has no presence of cavities which, on one hand, allows an extremely close arrangement of the air and fuel passages to one another without a possible occurrence of accidental communication between the passages and, on the other hand, causes aggravation of mechanical strength of the carburetor, so as to bring about not only the necessity of a reinforcement for the carburetor for installation to the intake manifold without an occurrence of deformation and/or damage, but also the difficulty of firmly and steadily mounting functional parts generally made of metal such as a throttle valve and jets to the carburetor.

Many of the air and fuel passages and bleed air passages that are formed in the metal carburetor barrel body or the synthetic carburetor barrel body usually have bent sections. Such passages are formed by drilling the carburetor barrel body from various sides and are then plugged at one end with stoppers such as a ball plug, respectively, which is always undesirable in light of preventing or significantly lowering the number of working man-hours, the number of parts and possibilities of leakage of fuel and/or air. Furthermore, the carburetor barrel body, which is an aluminum die-cast product, has a considerably complicated mechanical structure, so as to often yield cavities distributed in the cast, which are commonly called "blow holes". In consequence, the air and fuel passages that are drilled and arranged extremely close to one another in the carburetor barrel body are accidentally interconnected to one another through the cavities. Especially, carburetors for use with general purpose engines are small in size and typically employ horizontal air horns. In such a carburetor that is made up of a carburetor barrel body formed with a horizontal air horn, a fuel bowl secured to the carburetor barrel body, and a column-shaped fuel trunk formed with fuel passages therein which is installed between the carburetor barrel body and fuel bowl so as to extend along a vertical center line from the carburetor body, there are quite a lot of chances of an occurrence of accidental interconnection between the fuel passages through cavities due to an extremely close arrangement, which leads to one of the causes of a decline in yield rate of finished carburetors. Such a passage is formed by drilling the carburetor barrel body from various sides and is then plugged at one end with a stopper such as a ball plug, which is always undesirable in light of preventing or significantly lowering the number of working man-hours, the number of parts and possibilities of leakage of fuel and/or air.

SUMMARY OF THE INVENTION

It is an object of the present invention to provide a carburetor for, in particular, a general purpose internal combustion engine, which improves the issue that a metal die-cast carburetor barrel body is one of the problems of high temperature restarting of the engine.

It is another object of the present invention to provide a carburetor which overcomes the problem that a synthetic resin carburetor barrel body is employed with the intention to overcome the issue that a metal die cast carburetor barrel body is one of the problems of high temperature restarting of the engine, and in other words, the issue that a carburetor with a synthetic resin carburetor barrel body incorporated therein is lacking in mechanical strength.

It is another object of the present invention to provide a carburetor having a structure that realizes assembling performance of functional parts relating to the carburetor.

It is still another object of the present invention to provide a carburetor in which it is relatively easy to form fuel and/or air passages.

It is a further object of the present invention to provide a carburetor which has a structure that prevents or significantly reduces the possibility of interconnection between fuel and/or air passages and fuel leakage.

According to one aspect of the present invention, in a carburetor which comprises a carburetor barrel body having a horizontal air passages, a fuel bowl secured to the bottom of the carburetor barrel body, a column-shaped fuel trunk disposed between the fuel tank and carburetor barrel body so as to extend from and align with a vertical center line of the carburetor barrel body, and fuel passage means disposed partly in the carburetor barrel body and partly in the column-shaped fuel trunk for delivering fuel into the horizontal air passages, significant improvement is achieved by providing the carburetor barrel body and the column-shaped fuel trunk separately by forming them from different materials, namely a metal and a synthetic resin, respectively, and forming fuel wells in the column-shaped fuel trunk. The carburetor structure in which the column-shaped fuel trunk with the fuel wells formed therein is made of synthetic resin that is lower in heat conductivity than metals and is half dipped in liquid fuel in the fuel chamber in practical use prevents or significantly reduces transfer of high temperature heat from the engine after an engine stop, so as to allow only a small quantity of fuel to evaporate from the fuel wells or to restrain evaporation of liquid fuel introduced into the fuel well at an engine restart even if a large quantity of fuel has evaporated from the fuel wells, ensuring an easy restarting of the engine that remains still hot. The carburetor barrel body that is connected to an intake manifold is made of metal, and has a sufficient mechanical strength for steady installation of functional parts such as throttle valve and a choke thereto.

The carburetor structure in which each or both of a low speed fuel passage and a fuel supply passage are formed partly in the shape of groove in an interface between the carburetor barrel body and the column-shaped fuel trunk yields a significant reduction in man-hours for drilling the carburetor barrel body from various sides and the column-shaped fuel trunk to form bores for passages, and also eliminates, in combination with utilization of synthetic resin for the column-shaped fuel trunk, the possibility of interconnection of the passages arranged close to one another in the column-shaped fuel trunk. That is to say, because the carburetor barrel body formed with the intake passage and the column-shaped fuel formed with the wells are separately made of metal and synthetic resin, respectively, the carburetor yields high temperature engine start ability without loosing necessary mechanical strength and realizes formation of the fuel passages and air bleed passages that is free from air and/or fuel leakage with a reduced number of working man-hours by utilization of the interface between the carburetor barrel body and column-shaped fuel trunk.

According to another aspect of the present invention, in a carburetor which comprises a carburetor barrel body made of metal having a horizontal air passage extending transversely therethrough, a fuel container forming a constant level fuel chamber therein and coupled to a bottom the carburetor barrel body, a column-shaped fuel trunk formed with fuel wells which is made of synthetic resin separately from the carburetor barrel body and disposed between the carburetor barrel body and the fuel container so as to extend from and align with a vertical center line of the carburetor barrel body, and fuel passage means disposed partly in the carburetor barrel body and partly in the column-shaped fuel trunk for delivering fuel into the horizontal air passage, significant improvement is achieved by providing the column-shaped fuel trunk with an integral top flange and installing the column-shaped fuel trunk between the carburetor barrel body and the fuel container so as to extend from the carburetor barrel body into the fuel container by bolting the fuel container to the carburetor barrel body in positions outside of the mounting flange of the column-shaped fuel trunk with the top flange of the column-shaped fuel trunk put in a tight contact condition between the fuel container and the carburetor barrel body so as thereby to provide a tight interface between the carburetor barrel body and the top flange of the column-shaped fuel trunk. The carburetor thus structured exerts a coupling force on the top flange of the column-shaped fuel trunk and the column-shaped fuel trunk itself at the center of the top flange indirectly through the fuel container, as a result of which the column-shaped fuel trunk is prevented from deformation or damage due to strong direct compressive stress and receives a uniform load over the entire surface area of the top flange thereof with an effect of providing a watertight and airtight interface between the carburetor barrel body and the top flange of the column-shaped fuel trunk, so as thereby to prevent the fuel passage from fuel leakage at the interface. The carburetor may further comprise sealing means for sealing an outer periphery of the interface and the fuel passage in the interface with an effect of providing more reliable water-tightness and air-tightness.

The fuel passage means may include the low speed fuel passage and/or fuel supply passage being partly defined as grooves in the interface. In this instance, the sealing means is configured so as to seal, in addition to the outer periphery of the interface and the main fuel passage in the interface, the groove-shaped passage sections. Utilization is made of the interface between the carburetor barrel body and the flange of the column-shaped fuel trunk for the grooves which are used as parts of the fuel passages, which yields a significant reduction in man-hours for drilling the carburetor barrel body from various sides and also eliminates, in combination with utilization of the sealing means and utilization of synthetic resin for the column-shaped fuel trunk in which the fuel passages are formed close to one another, the possibility of interconnection of the passages and leakage of fuel from the passages, which leads to significantly increased reliability of the carburetor. That is to say, because the carburetor thus structured exerts a coupling force on the top flange of the column-shaped fuel trunk and the column-shaped fuel trunk itself indirectly through the fuel container, the column-shaped fuel trunk with its top flange, which is delicate in mechanical strength, is prevented from deformation and/or damage, so that the carburetor barrel body and the flange of the column-shaped fuel trunk can be tightly contacted with a force sufficiently strong as to prevent leakage of fuel and/or air through the interface therebetween. Furthermore, utilization of the interface for the grooves which are used as parts of the fuel and air passages yields a significant reduction in man-hours for forming the fuel and air passages in the carburetor barrel body, and utilization of the sealing means between the carburetor barrel body and the flange of the column-shaped fuel trunk provides the passage means with high water-tightness and air-tightness with an effect of eliminating fuel and/or air leakage.

BRIEF DESCRIPTION OF THE DRAWINGS

The above and other objectives and features will be clearly understood from the following description with respect to preferred embodiments thereof when read in conjunction with the accompanying drawings, where the same reference numerals have been used to denote the same or substantially the same parts throughout the embodiments, and in which.

DETAILED DESCRIPTION OF THE PREFERRED EMBODIMENTS

Figure 1:
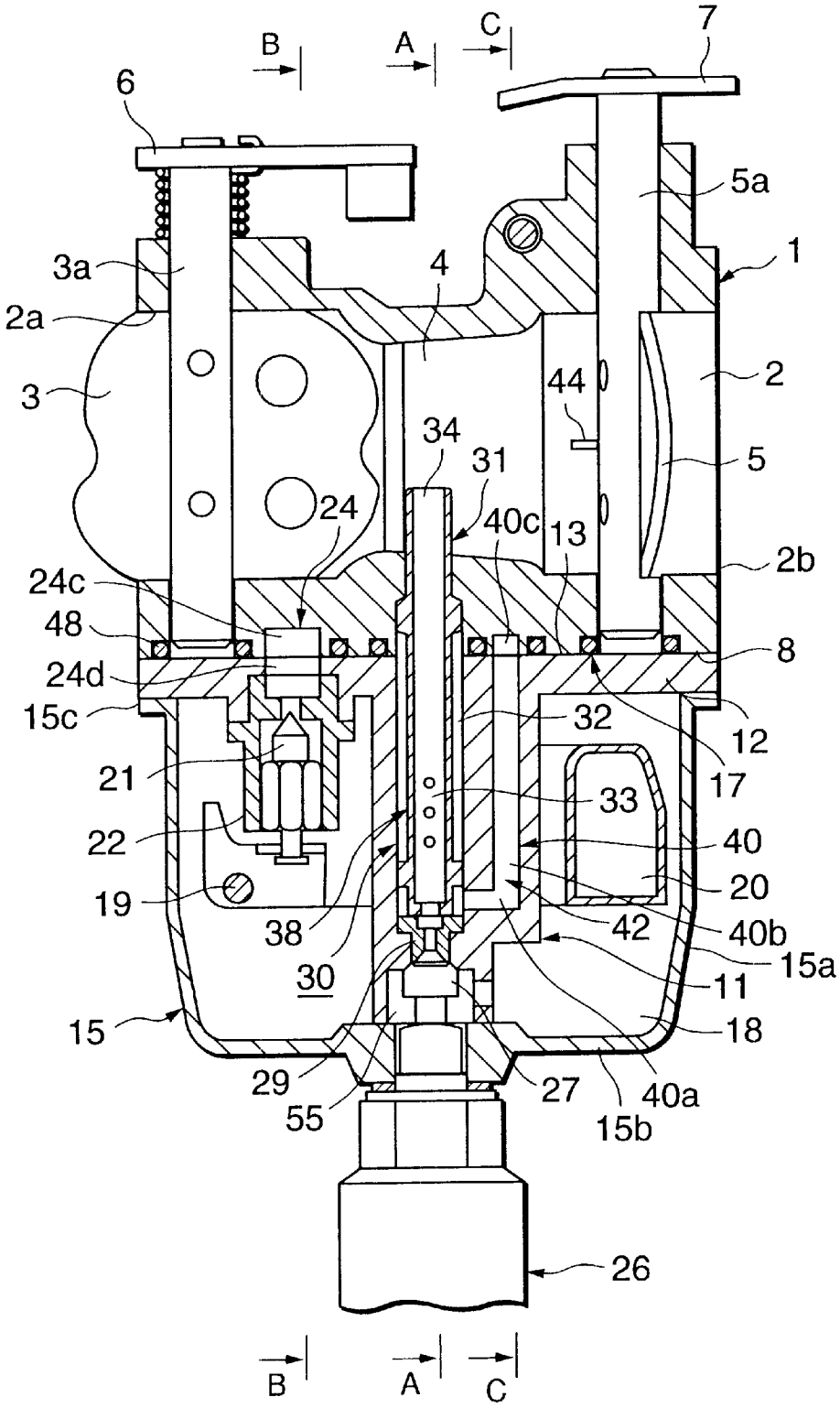
FIG. 1 is a longitudinal-sectional view of a carburetor for a general purpose engine in accordance with a preferred embodiment of the present invention.

In the following description, parts which are not of direct importance to the invention and parts which are of purely conventional construction will not be described in detail. For example, details of the choke valve, the throttle valve, the fuel shut-off valve, the float equipped with a needle valve, their associated mechanisms and so on which are necessary to the carburetor will not be set out in detail since construction and operation can easily be arrived at by those skilled in the art.

Referring to the drawing in detail, in particular, to FIGS. 1 to 5 showing a carburetor for a general purpose engine in accordance with an embodiment of the present invention, the carburetor has a barrel 1 as a carburetor body, which is made as an aluminum die-cast product in this embodiment. The carburetor barrel body 1 has an air intake passage 2 as a horizontal air horn that is defined by a bore longitudinally passing through the carburetor barrel body 1 and a circular bottom wall 8 having a diameter equal to the overall length of the air intake passage 2. This intake passage 2 is formed with a venturi 4 substantially at the middle and is provided with a choke valve 3 on one side of the venturi 4 close to an air inlet port 2*a* and a throttle valve 5 on another side of the venturi 4 close to an air outlet port 2*b*. A valve shaft 3*a*, integrally formed with or fixedly attached to the choke valve 3, is supported for pivotal movement on the carburetor barrel body 1 and linked to a choke lever 6 so as to open and close the choke valve 3. A valve shaft 5*a*, integrally formed with or fixedly attached to the throttle valve 5, is supported for pivotal movement on the carburetor barrel body 1 and linked to a throttle lever 7 so as to open and close the throttle valve 5. The choke valve 3 and the throttle valve 5 and their associated mechanisms are known in various forms and may take any forms, respectively, that are well known to those skilled in the art. A column-shaped fuel trunk 11 at its top has a circular top flange 12 having the same outer diameter as the bottom wall 8 of the carburetor barrel body 1 that is secured to the circular bottom wall 8 of the carburetor barrel body 1.

The column-shaped fuel trunk 11 and it's top flange 12 are integrally formed as a hard synthetic resin molding product. A fuel bowl 15, which may be made as a deep draw metal product, has an annular mounting flange 15*c* in conformity with the outer configuration of the bottom wall 8 of the carburetor barrel body 1 and the top flange 12 of the column-shaped fuel trunk 11. The fuel bowl 15 is fixedly secured to the carburetor barrel body 1 by fastening bolts 16 (see FIGS. 2 and 3) so as to fixedly couple the mounting flange 15*c* of the fuel bowl 15, the top flange 12 of the column-shaped fuel trunk 11 and the bottom wall 8 of the carburetor barrel body 1 all together.

There is provided a hermetic interface 17 between the under surface of the bottom wall 8 and the top surface 13 of the flange 12 of the column-shaped fuel trunk 11 firmly joined to each other with coupling strength uniform over their entire surfaces.

The fuel bowl 15 forms in its interior a constant level fuel chamber 18 in which the column-shaped fuel trunk 11 extends to a bottom wall 15*b* of the fuel bowl 15 and is secured to the same. Inside of the fuel chamber 18, a float 20 is hinged by a support pin 19. The float 20 is provided with a needle valve 21 installed in a valve seat body 22 secured to the top flange 12 of the column-shaped fuel trunk 11. The structure and mechanism of the fuel bowl and float are known in various forms and may take any form well known to those skilled in the art.

Figure 3:
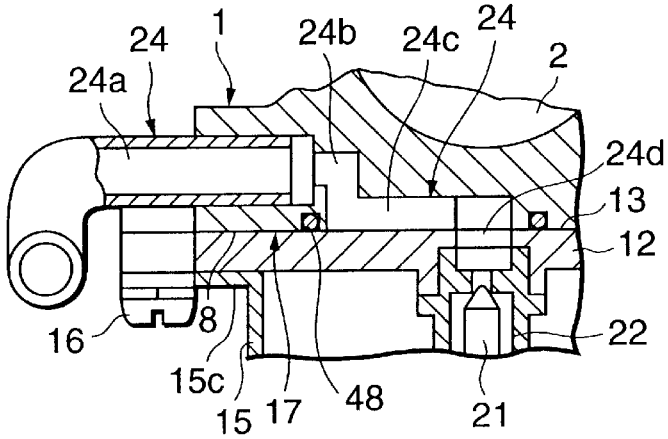
FIG. 3 is a longitudinal-sectional view taken along a line III—III of FIG. 1.
Figure 4:
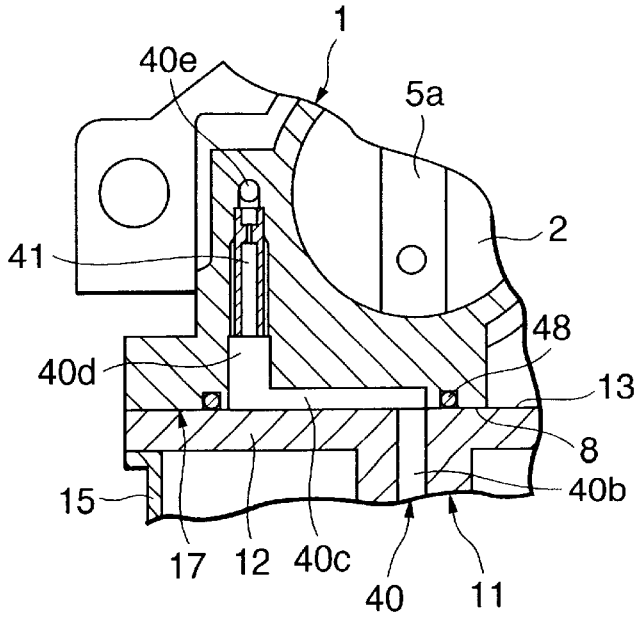
FIG. 4 is a longitudinal-sectional view taken along a line IV—IV of FIG. 1.

As shown in detail in FIG. 3, a fuel stream is supplied from a fuel tank (not shown) through a fuel inlet pipe 24*a* extending laterally from the carburetor and connected to a fuel pump (not shown). The fuel stream travels through a fuel supply passageway 24 and reaches a fuel inlet of the valve seat body 22. The fuel supply passageway 24 comprises a transverse passage section 24*b* which is defined by an L-shaped bore in the bottom wall 8 of the carburetor barrel body 1 to which the fuel inlet pipe 24*a* extends and which extends initially transversely and then vertically downward, a transverse passage section 24*c* which is formed as a groove in the bottom wall 8 so as to open to the underside of the bottom wall 8, and a vertical passage section 24*d* which is formed in the top flange 12 of the column-shaped fuel trunk 11 by a bore passing through. As is well known in the automobile art, when the fuel bowl 15 fills to a predetermined fuel level, the float 20 rises and urges the needle valve against the valve seat of the valve seat body 22 to stop the flow of fuel. On the other hand, when the fuel level drops, the float 20 releases its pressure, the needle valve lifts from the seat and more fuel enters. The float 20 and needle valve 21 keep the fuel level in the fuel bowl 15 constant. The fuel bowl 15 is equipped with a solenoid operated fuel shut-off valve assembly 26 installed to a bottom wall 15*a* from the outside.

The fuel shut-off valve assembly 26 has a valve body 27 which is disposed inside of a valve chamber 55 formed at the lower distal end of the column-shaped fuel trunk 11 and operative to open and close a main metering jet 29 that is installed into an inlet end of a fuel discharge passage 30 formed immediately above the valve chamber 55 in the column-shaped fuel trunk 11. The valve body 27 is operated to close the main metering jet 29 at the inlet side when the engine stops and to open the main discharge jet 29 to admit a metered amount of fuel, that enters the valve chamber 55 from the fuel chamber 18, into the fuel discharge passage 30 when the engine is actuated.

The fuel discharge passage 30 includes two circuits, which are often called a system, namely a main circuit and a low speed circuit. The main circuit comprises a main fuel discharge passage 31 extending straight up to a throat of the venturi 4 from the main discharge jet 29 passing through the bottom wall 8 of the carburetor barrel body 1. The low speed circuit comprises a low speed fuel discharge passage 40 branching off from the main fuel discharge passage 31 at a juncture to the main metering jet 29 and extending to a low speed port chamber 43 formed with a low speed port 44 that opens into the air intake passage 2 immediately after the throttle valve 5 as shown in FIG. 6.

Specifically, the main fuel discharge passage 31 is defined by an emulsion pipe 33 disposed in a straight mounting bore 32 that is continuously formed in the column-shaped fuel trunk 11 and the bottom wall 8 of the carburetor barrel body 1, and a main discharge nozzle 34 which is formed as an integral part of the emulsion pipe 33 and press-fitted into an upper part of the straight mounting bore 32 formed in the bottom wall 8 of the carburetor barrel body 1. The emulsion pipe 33 at its lower distal end is abutted against the main metering jet 29 at the outlet side so as thereby to be firmly situated at the lower distal end of the mounting bore 32.

Figure 2:
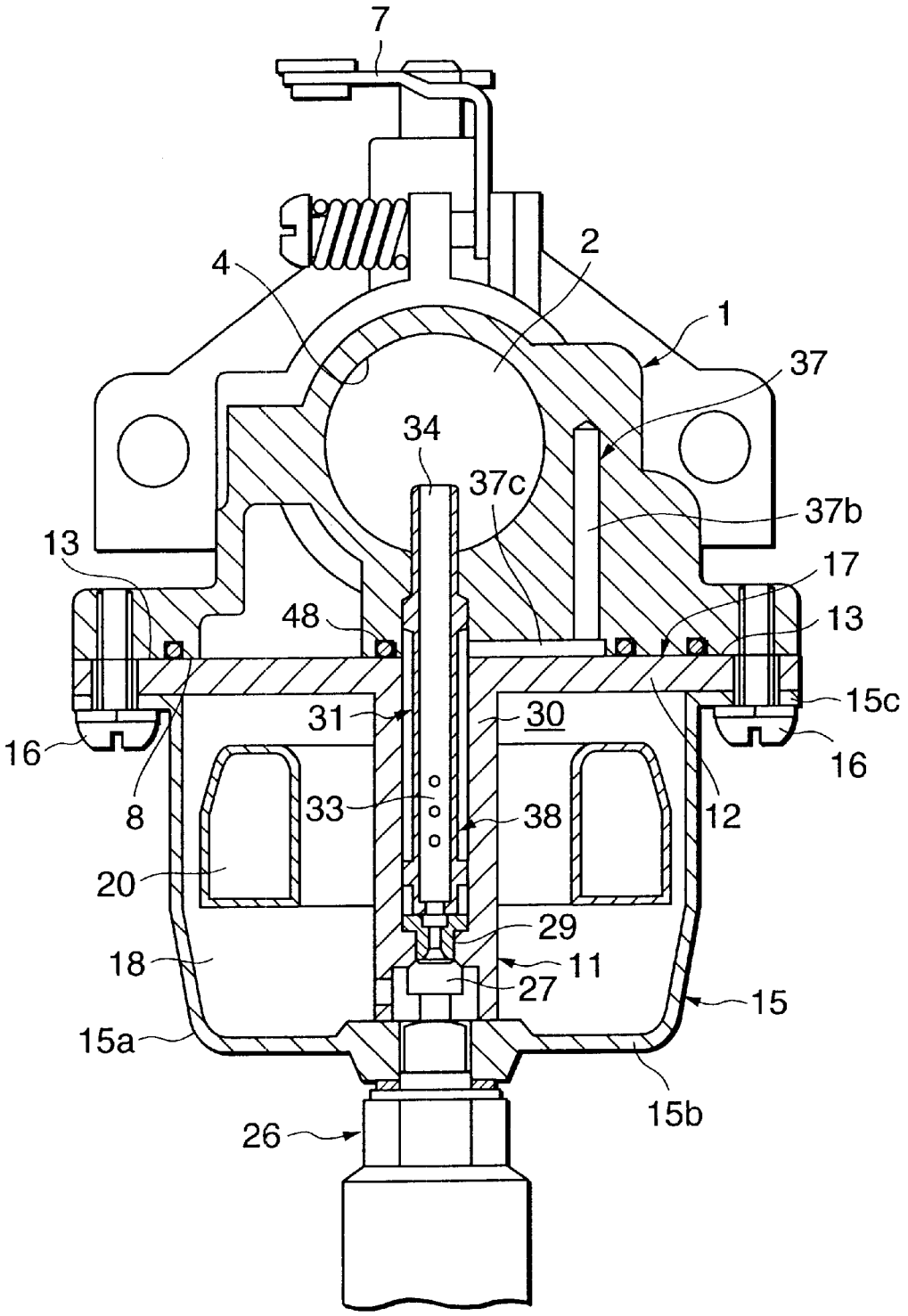
FIG. 2 is a longitudinal-sectional view taken along a line II—II of FIG. 1.
Figure 5:
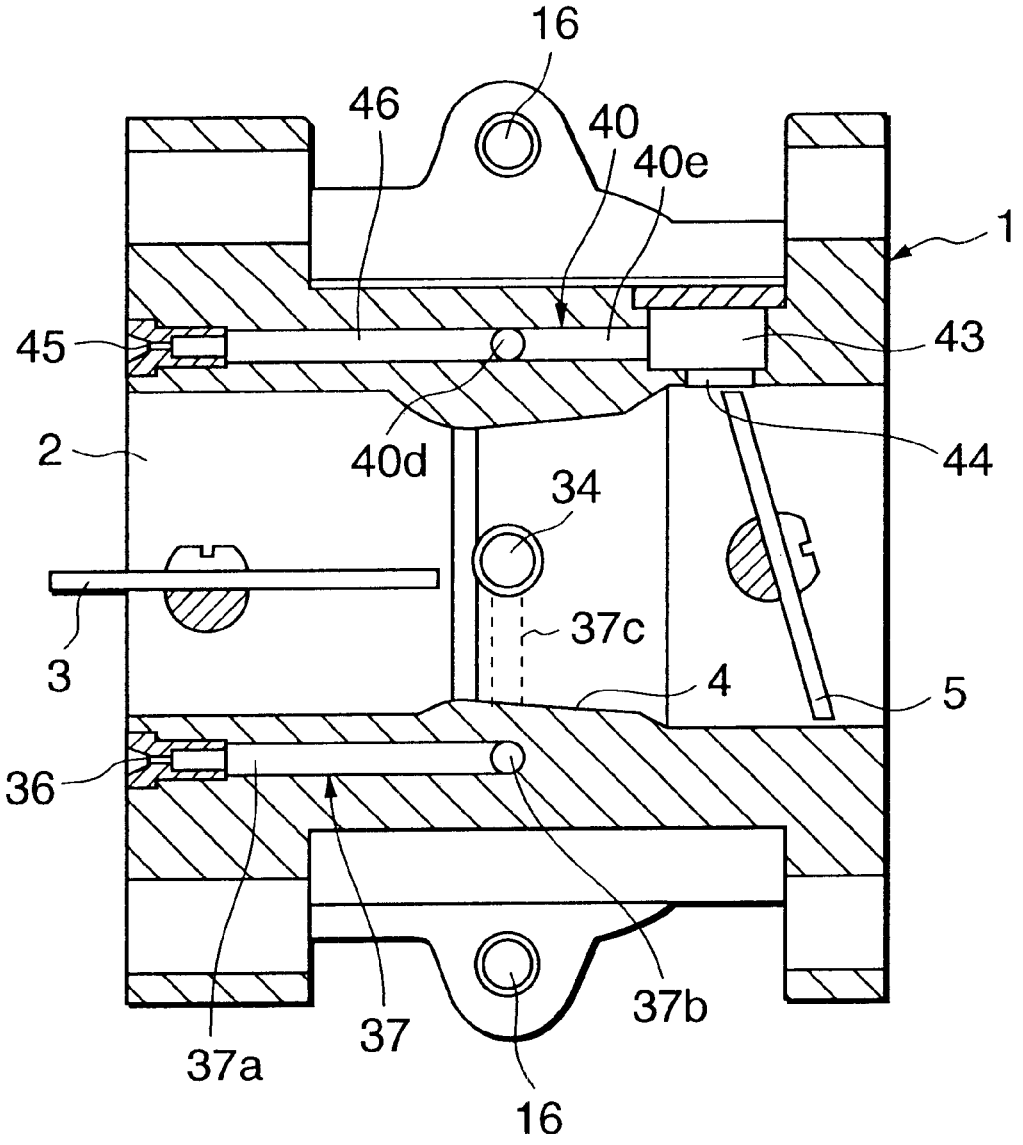
FIG. 5 is a cross-sectional view taken along a line V—V of FIG. 1.
Figure 6:
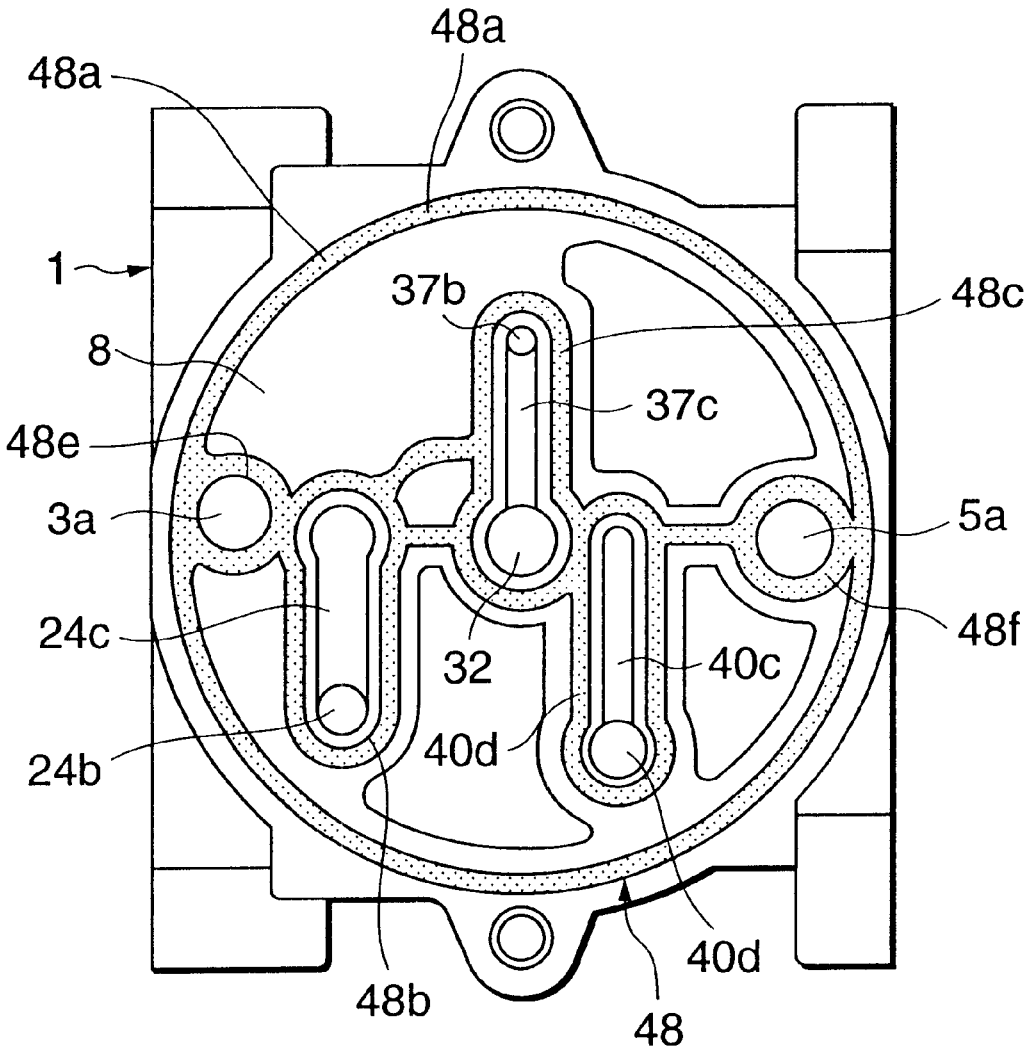
FIG. 6 is a bottom view of a barrel of the carburetor.
Figure 7:
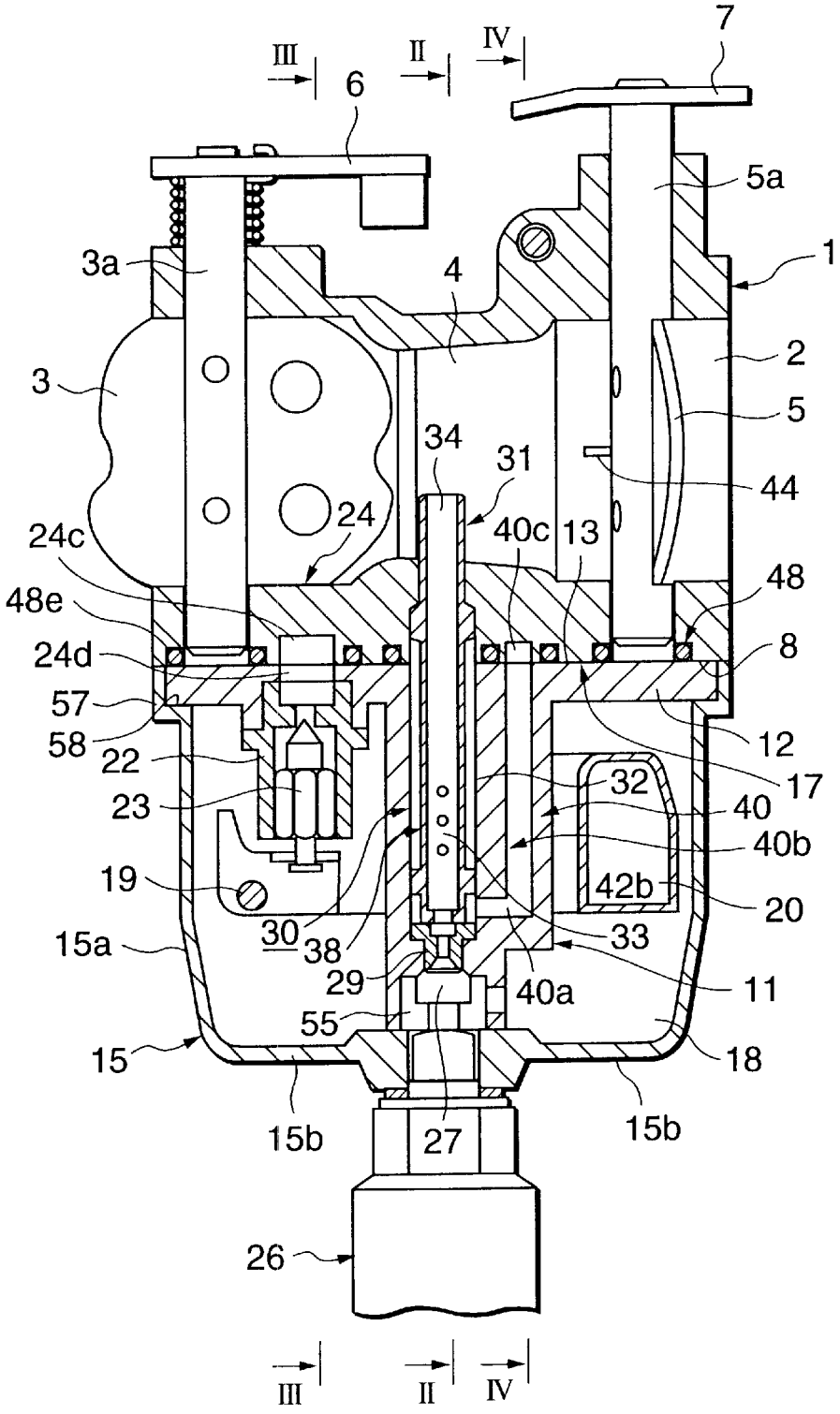
FIG. 7 is a longitudinal-sectional view of a carburetor for a general purpose engine in accordance with another preferred embodiment of the present invention.
Figure 8:
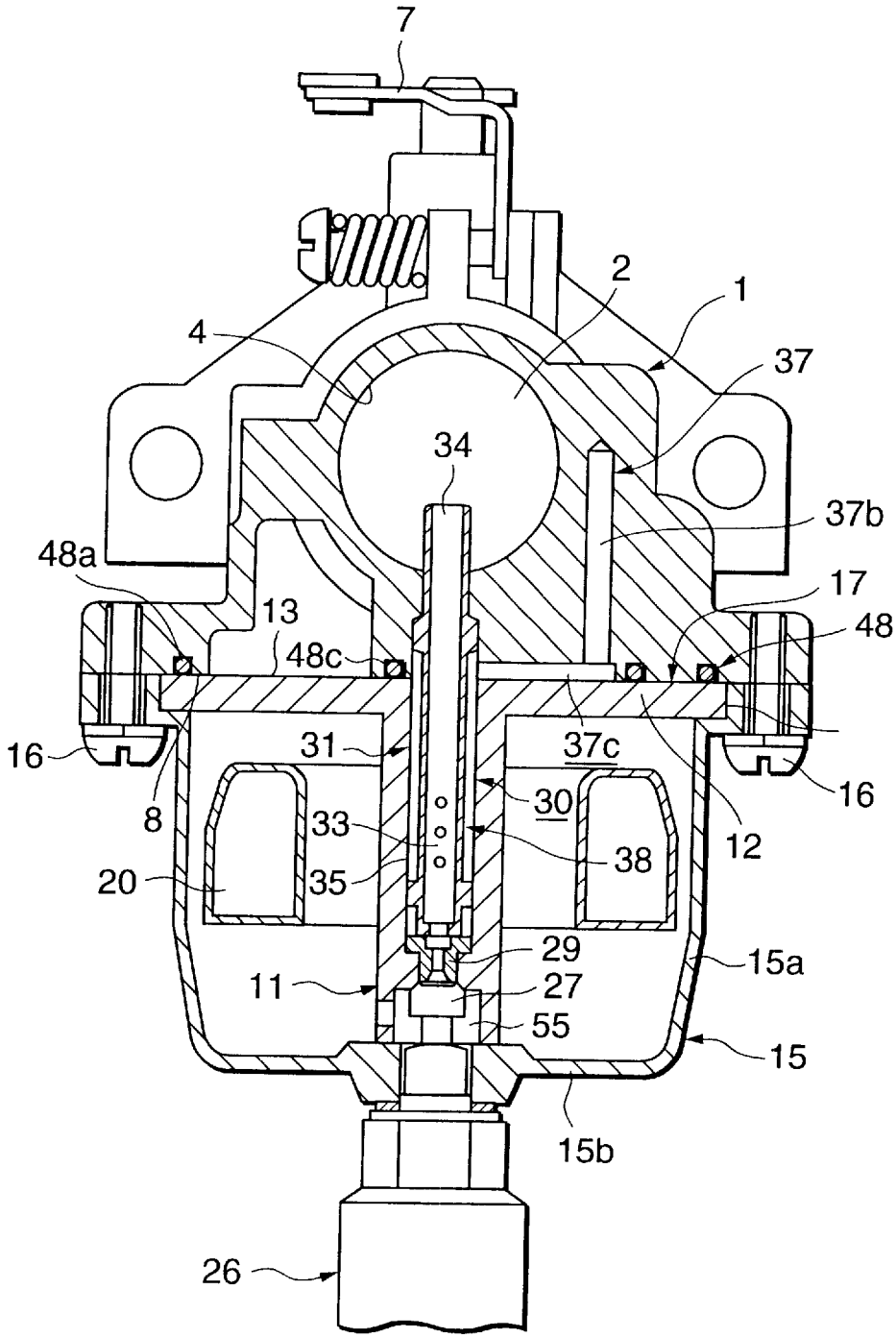
FIG. 8 is a longitudinal-sectional view taken along a line VIII—VIII of FIG. 7.
Figure 9:
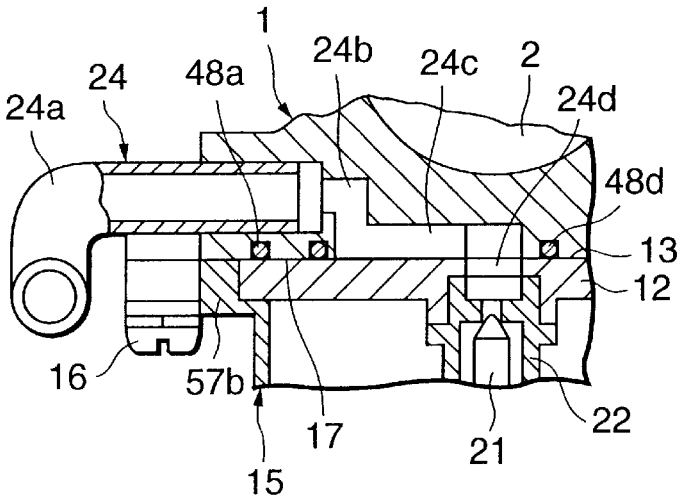
FIG. 9 is a longitudinal-sectional view taken along a line IX—IX of FIG. 7.
Figure 10:
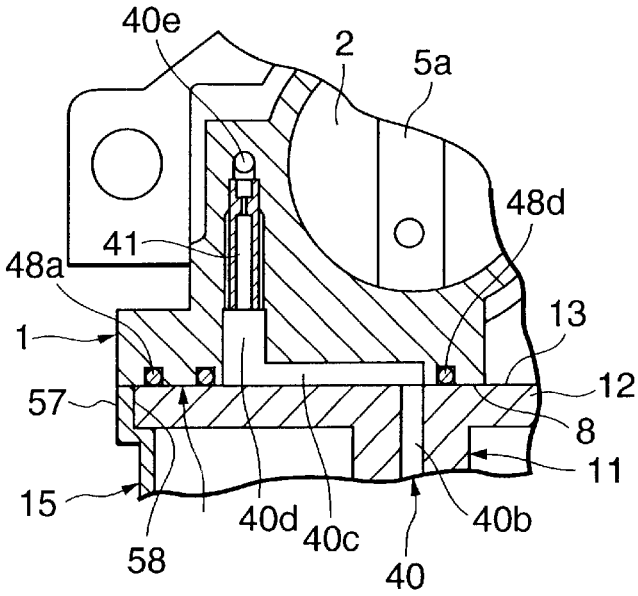
FIG. 10 is a longitudinal-sectional view taken along a line X—X of FIG. 7.

As shown in FIGS. 2, 5 and 6, a main bleed air passage 37 through which air travels extends from one side surface of the carburetor barrel body 1 at which the air inlet port 2*a* of the air intake passage 2 opens to the top of the mounting bore 32. An air jet 36 is fitted in an inlet of the main bleed air passage 37 and opens to the atmosphere.

The main bleed air passage 37 comprises an upper longitudinal passage section 37*a* which is defined by a bore extending longitudinally halfway along the air intake passage from the side surface of the carburetor barrel body 1, a vertical passage section 37*b* which is defined by a vertical bore extending downward from the upper longitudinal passage section 37*a,* and a lower transverse passage section 37*c* which is defined by a groove extending transversally from the vertical passage section 37*b* to the mounting bore 32. A tiny stream of air introduced into the main bleed air passage 37 through the air jet 36 is added to the fuel as it travels through the main discharge nozzle 34, so that fuel drops leave readily and are quite small.

As shown in FIGS. 1 and 4 to 6, the low speed fuel discharge passage 40 comprises a lower longitudinal passage section 40*a* which extends branching off from the lower distal end of the mounting bore 32 where the main metering jet 29 is installed into the inlet end of a fuel discharge passage 30, a lower vertical passage section 40*b* which is formed in the column-shaped fuel trunk 11 and extends vertically upward from the longitudinal passage section 40*a* along the whole length of the mounting bore 32, a transverse passage section 40*c* which is formed as a groove extending transversely in the circular bottom wall 8 of the carburetor barrel body 1 so as to face the underside, an upper vertical passage section 40*d* which extends vertically upward on one side of the air intake passage 2 and is connected to the lower vertical passage section 40*b* through the transverse passage section 40*c,* and an upper longitudinal passage section 40*e* which extends longitudinally on the one side of the air intake passage 2 from the upper vertical passage section 40*d* to the low speed port chamber 43. A low speed metering jet 41 is press fitted in the upper vertical passage section 40*d.*

The fuel that enters the emulsion pipe 33 through the main metering jet 29 partly flows into the low speed fuel discharge passage 40 at the lower distal end of the mounting bore 32 and is subsequently metered as it travels through the low speed metering jet 41 and is discharged into the air intake passage 2 from the low speed port 44. As shown in FIG. 5, there is a low speed bleed air passage 46 disposed on one side of the air intake passage 2 opposite to and in parallel with the main bleed air passage 37 and extending from the longitudinal passage section 40*e* of the low speed fuel discharge passage 40 to the one side surface of the carburetor barrel body 1. An air jet 45 is fitted in an inlet of the low speed bleed air passage 46 and opens to the atmosphere. A tiny stream of air introduced into the low speed bleed air passage 46 through the air jet 45 is added to the fuel as it travels.

In the carburetor according to the above embodiment, the column-shaped fuel trunk 11, which is prepared as a synthetic resin molding product and which is provided with a fuel well 38 defined in the emulsion tube 33 used as the main fuel discharge passage 31 and a fuel well 42 defined by the longitudinal passage section 40*a* and a lower half of the mounting bore 32 that is continuously formed in the column-shaped fuel trunk 11 in the inside thereof, is always half dipped in liquid fuel in the fuel chamber 18, so that fuel in the fuel wells 38 and 42 is less inclined to evaporate even when the engine and its surroundings are still at a high temperature after an engine stop. Furthermore, even if a large amount of fuel possibly evaporates due to heat that the main discharge nozzle 34 and emulsion nozzle 33 receive from the carburetor barrel body 1, the evaporation of fuel that is introduced at an engine restart is restrained to a small amount, which ensures an easy restart of the engine even at a high temperature.

The carburetor barrel body 1 that is connected to the intake manifold is provided as a metal die-cast product which generally has a mechanical strength sufficiently high for installation of the choke valve 3, throttle valve 5 and main discharge nozzle 34. On the other hand, although the column-shaped fuel trunk 11 made as a synthetic resin mold product is inferior in mechanical strength to the carburetor barrel body 1, the structure in which the column-shaped fuel trunk 11 is supported, between the bottom wall 8 of the carburetor barrel body 1 and the bottom wall 15*b* of the fuel bowl 15 and reinforced with the main discharge nozzle 34 and emulsion pipe 33, prevents the column-shaped fuel trunk 11 from deforming and keeps it in a given shape and position, which is desirable for stable installation of the main metering jet 29 in the column-shaped fuel trunk 11.

The synthetic resin column-shaped fuel trunk 11 is free from the presence of air bubbles comparable to the cavities formed in die-cast products, so that the mounting bore 32 and lower vertical passage section 40*b* of the low speed fuel discharge passage 40 that are formed in the column-shaped fuel trunk 11 are prevented from being accidentally brought into communication with each other with the result of loosing their primary functions.

Furthermore, according to the structure of the carburetor, the bore forming the transverse passage section 24*b* of the fuel supply passageway 24 is drilled in the carburetor barrel body 1 partly from one of the flanks of the carburetor barrel body 1 and partly from the underside of the carburetor barrel body 1, and the vertical passage section 24*d* of the fuel supply passageway 24 is formed in the column shaped fuel trunk 11 by the use of, for example, a return pin of a casting die.

Further, the bore 32 and the lower vertical passage section 40*b* of the low speed fuel discharge passage 40 in the column-shaped fuel trunk 11 for the main fuel discharge passage 31 are formed by using pins or rods together with a casting die for the carburetor barrel body 1 and a molding die for the column-shaped fuel trunk 11, or may be, if desired, drilled in the carburetor barrel body 1 and the column-shaped fuel trunk 11. The longitudinal passage section 37*a* and vertical passage section 37*b* of the main bleed air passage are drilled in the carburetor barrel body 1 partly from one of the flanks of the carburetor barrel body and partly from the underside of the carburetor barrel body 1. Further, the upper vertical passage section 40*d* of the low speed fuel discharge passage 40 is drilled in the carburetor barrel body 1 from the underside of the carburetor barrel body 1, and the upper longitudinal passage section 40*e* of the low speed fuel discharge passage 40 and the low speed bleed air passage 46 are drilled in the carburetor barrel body 1 from one of the flanks of the carburetor barrel body 1.

Since the lower transverse passage sections 37*c,* 24*c* and 40*c,* all of which are formed in the shape of groove, are easily formed by embossing dies which are in conformity with the grooves and formed as integral parts of a casting die for the carburetor barrel body 1, all of passages 24, 31, 37, 40 and 46, through which fuel or air flow, are made completely free from apprehension of leakage by sealing up only the end of the lower longitudinal passage section 40*a* of the low speed fuel discharge passage 40 that is drilled, which requires only a small number of working man-hours.

In this instance, since the transverse passage section 40*c* of the low speed fuel discharge passage 40 in the form of a groove has a considerably small capacity, even if the fuel in the transverse passage section 40*c* of the low speed fuel discharge passage 40 evaporates in the period of engine stop, the transverse passage section 40*c* of the low speed fuel discharge passage 40 is immediately filled with fuel upon restarting the engine, so that the evaporation of fuel is not in any way an obstacle to a restart while the engine remains hot.

In this instance, the interface 17 is hermetic in itself, as it joins the under surface of the bottom wall 8 of the carburetor barrel body 1 and the top surface 13 of the top flange 12 of the column-shaped fuel trunk 11 with uniform strength of joining over their entire surfaces, so as to provide the mounting bore 32 and passage sections 24*c,* 37*c* and 40*c,* all of which extend through the interface 17, with water-tightness and air-tightness. In order to ensure sealing between the interface 17 and each of the mounting bore 32 and passage sections 24*c,* 37*c,* and 40*c* so as thereby to make the water-tightness and air-tightness more reliable, a sealing gasket 48 is incorporated as will be described in detail later in conjunction with FIG. 6. In order to ensure air-tightness between the bottom wall 8 of the carburetor barrel body 1 and the valve shaft 3*a* of the choke valve 3 and the valve shaft 5*a* of the throttle valve 5, respectively, the sealing gasket 48 is configured with an annular sealing section shaped like an O-ring that surrounds the entire area of the interface 17 and with annular sealing sections, formed as integral parts of the gasket, that surround the valve shafts 3*a* and 4*b,* respectively. The sealing member 48 is put between the bottom wall 8 of the carburetor barrel body 1 and the top flange 12 of the column-shaped fuel trunk 11, which are made of different materials, so as to form the hermetic interface 17 between them.

Referring to FIG. 6, the sealing gasket 48, which is formed as an integral piece, comprises an annular gasket section 48*a,* elongated gasket sections 48*b,* 48*c* and 48*d* which are arranged substantially in parallel to one another in the transverse direction, and annular gasket sections 48*e* and 48*f* which are arranged in diametrically opposite positions and between which the elongated gasket sections 48*b,* 48*c* and 48*d* are joined to one another.

Specifically, the annular gasket section 48*a* is shaped so as to surround the substantially entire area of the interface 17. The elongated gasket section 48*b* is shaped and transversely extends so as to surround the groove shaped passage section 24*c* forming part of the fuel supply passageway 24 and the lower end of the L-shaped transverse passage section 24*b* forming parts of the fuel supply passageway 24. The elongated gasket section 48*c* is shaped and transversely extends so as to surround an upper portion of the mounting bore 32 and the lower transverse passage section 37*c* of the main bleed air passage 37 including the lower end of the vertical passage section 37*b* of the main bleed air passage 37. The elongated gasket section 48*c* is shaped and transversely extends so as to surround the transverse passage section 40*c* of the low speed fuel discharge passage 40 including the lower end of the upper vertical passage section 40*d* of the low speed fuel discharge passage 40. Further, the annular gasket sections 48*e* and 48*f* encircle the valve shaft 3*a* of the choke valve 3 and the valve shaft 5*a* of the throttle valve 5, respectively. The bottom wall 8 is formed with a gasket groove (not shown) in exact conformity with the sealing gasket 48 to receive it firmly in the gasket groove. The sealing gasket 48 thus made as an integral piece is easy to handle and convenient to mount to the carburetor barrel body 1. Moreover, employing the sealing gasket 48 provides the carburetor with more reliable water-tightness and air-tightness.

Although the passage sections 24*c,* 37*c* and 40*c* comprise grooves formed in the bottom wall 8 of the carburetor barrel body 1, each of the passage sections 24*c,* 37*c* and 40*c* may be otherwise made up of two mating groove halves, one of which is formed as a down-facing groove in the bottom wall 8 of the carburetor barrel body 1 and the other of which is formed as an up-facing groove in the top flange 12 of the column-shaped fuel trunk 11. The fuel supply passageway 24 may be configured to leave the transverse passage section 24*c* out and lay out the transverse passage section 24*b* and 24*c* directly. Further, the main bleed air passage 37 may be configured as a single straight passage that extends at a slant in the carburetor barrel body 1 to the mounting bore 32. The column-shaped fuel trunk 11 may be installed so as to abut the lower distal end of the column-shaped fuel trunk 11 against the valve body of the solenoid operated fuel shut-off valve assembly 26 so as thereby to support the column-shaped fuel trunk 11 indirectly on the bottom wall 15*b* of the fuel bowl 15.

Referring to FIGS. 7 to 10 showing a carburetor for a general purpose engine in accordance with another preferred embodiment of the present invention, which is has same constructional cross-section and bottom arrangement of a carburetor barrel body 1 as those shown in FIG. 5, a fuel bowl 15, which may be made as a general deep draw metal product, is formed at its top with a generally L-shaped annular mounting flange 57*b* with a shoulder 58 at the inside. Specifically the fuel bowl 15 is configured so as to have an outer diameter equal to an outer diameter of a circular bottom wall 8 of a carburetor barrel body 1 and an inner diameter and an inner height equal to an outer diameter and a thickness of a circular top flange 12 of a column-shaped fuel trunk 11, respectively, so as to receive firmly and snugly the top flange 12 of the column-shaped fuel trunk 11 on the shoulder 58. The column-shaped fuel trunk 11 has its lower distal end abutted against the center of a bottom wall 15*b* of the fuel bowl 15 and the top flange 12 seated on the shoulder 58. This fuel bowl 15 with the column-shaped fuel trunk 11 installed thereto is attached to the bottom wall 8 of the carburetor barrel body 1 by fastening bolts 16 which extend into threaded mounting brackets that project laterally from the wall 18 of the carburetor barrel body 1 in diametrically opposite positions.

There is provided an interface 17 between the bottom wall 8 of the carburetor barrel body 1 and the top flange 12 of the column-shaped fuel trunk 11. The top flange 12 of the column-shaped fuel trunk 11 is pressed along its rim by the shoulder 58 of the mounting flange 57*b* of the fuel bowl 15 by means of the fastening bolts 16, and is concurrently urged upward at its center through the column-shaped fuel trunk 11 that is urged upward by the bottom wall 15*b* of the fuel bowl 15, so as to thereby be brought into uniform tight contact with the bottom wall 8 of the carburetor barrel body 1 over substantially the entire area thereof. A coupling force is exerted by the bolts 16 on the top flange 12 of the column-shaped fuel 11 not directly but indirectly through the mounting flange 57*b* of the fuel bowl 15 and escapable at the shoulder 58 of the mounting flange 57*b* of the fuel bowl 15, the top flange 12 of the column-shaped fuel trunk 11 being free from deformation and damage when the fuel bowl 15 with the column-shaped fuel trunk 11 installed therein is secured to the carburetor barrel body 1. The top of flange 12 of the column-shaped fuel trunk 11 has no part that possibly receives strong stress due to repeated thermal shocks, so as to be free from deformation, which ensures more reliable tight sealing of the interface 17.

It is to be understood that although the present invention has been described in detail with respect to preferred embodiments thereof, various other embodiments and variants may occur to those skilled in the art, which are within the scope and spirit of the invention, and such embodiments and variants are intended to be covered by the following claims.

What is claimed is:

1. A carburetor for a general purpose engine, comprising:

a carburetor barrel body having a horizontal intake air passage;

a fuel bowl having a constant level fuel chamber therein, said fuel bowl being disposed below and secured to said carburetor barrel body;

a fuel trunk having first and second fuel wells therein and having an integral top flange, said fuel trunk extending into said fuel bowl, and having a top portion which is attached to a bottom portion of said body;

a main fuel discharge passage which is provided within said body and said fuel trunk, which includes said first fuel well, and which is straight in a portion thereof extending from a location within said fuel trunk to a location within said body, said main fuel passage carrying fuel which is traveling from said fuel chamber to said intake air passage; and a low speed fuel discharge passage which is provided within said body and said fuel trunk, and which includes said second fuel well, a first passage section extending upwardly inside said fuel trunk, a second passage section formed by a groove in one of a top surface of said fuel trunk and a bottom surface of said body, and a third passage section extending upwardly inside said body, said low speed fuel discharge passage carrying fuel which is traveling from said fuel chamber to said intake air passage;

wherein said body and said fuel bowl are made of metal, said fuel trunk is made of synthetic resin, an outer circumference of said flange is disposed between and attached to each of said body and said fuel bowl, said top surface of said fuel bowl is adjacent said bottom surface of said body, and a bottom end of said fuel trunk contacts a bottom wall of said fuel bowl.

2. A carburetor according to claim 1, including an annular first seal which extends around said portion of said main fuel discharge passage, an annular second seal which extends around said groove defining a portion of said low speed fuel discharge passage, and an annular third seal which extends around said first and second seals, said first, second and third seals each being disposed between and sealing engaging said bottom surface of said body and said top surface of said fuel trunk.

3. A carburetor according to claim 2, wherein said first, second and third seals are each an O-ring, and are each a respective integral portion of a single seal part.

4. A carburetor according to claim 1, including a bleed air passage which includes a fourth passage section extending downwardly within said body and a fifth passage section formed by a groove in one of said top surface of said fuel trunk and said bottom surface of said body, said bleed air passage carrying air which is traveling to said main fuel discharge passage.

5. A carburetor according to claim 4, including an annular first seal which extends around said portion of said main fuel discharge passage, an annular second seal which extends around said groove defining a portion of said low speed fuel discharge passage, an annular third seal which extends around said groove defining a portion of said bleed air passage, and an annular fourth seal which extends around said first, second, and third seals, said first, second, third and fourth seals each being disposed between and sealingly engaging said bottom surface of said body and said top surface of said fuel trunk.

6. A carburetor according to claim 5, wherein said first, second, third and fourth seals are each an O-ring, and are each a respective integral portion of a single seal part.

7. A carburetor according to claim 4, including a fuel supply passage which is provided within said body and said fuel trunk, and which includes a sixth passage section extending within said body, a seventh passage section formed by a groove in one of said top surface of said fuel trunk and said bottom surface of said body, and an eighth passage section extending within said fuel trunk, said fuel supply passage carrying fuel which is traveling to said fuel chamber from a location external to said carburetor.

8. A carburetor according to claim 7, including an annular first seal which extends around said portion of said main fuel discharge passage, an annular second seal which extends around said groove defining a portion of said low speed fuel discharge passage, an annular third seal which extends around said groove defining a portion of said bleed air passage, an annular fourth seal which extends around said groove defining a portion of said fuel supply passage, and an annular fifth seal which extends around said first, second, third and fourth seals, said first, second, third, fourth and fifth seals each being disposed between and sealingly engaging said bottom surface of said body and said top surface of said fuel trunk.

9. A carburetor according to claim 8, wherein said first, second, third, fourth and fifth seals are each an O-ring, and are each a respective integral portion of a single seal part.

10. A carburetor according to claim 9, wherein said bottom surface of said body and said top surface of said fuel trunk are pressed tightly against each other, and wherein at least one of said bottom surface of said body and said top surface of said fuel trunk has a groove pattern therein which receives said seal part.

11. A carburetor according to claim 1, including a fuel supply passage which is provided within said body and said fuel trunk, and which includes a fourth passage section extending within said body, a fifth passage section formed by a groove in one of said top surface of said fuel trunk and said bottom surface of said body, and a sixth passage section extending within said fuel trunk, said fuel supply passage carrying fuel which is traveling to said fuel chamber from a location external to said carburetor.

12. A carburetor according to claim 11, including an annular first seal which extends around said portion of said main fuel discharge passage, an annular second seal which extends around said groove defining a portion of said low speed fuel discharge passage, an annular third seal which extends around said groove defining a portion of said fuel supply passage, and an annular fourth seal which extends around said first, second, and third seals, said first, second, third and fourth seals each being disposed between and sealingly engaging said bottom surface of said body and said top surface of said fuel trunk.

13. A carburetor according to claim 12, wherein said first, second, third and fourth seals are each an O-ring, and are each a respective integral portion of a single seal part.

14. A carburetor according to claim 1, wherein said bottom surface of said body and said top surface of said fuel trunk are pressed tightly against each other.

15. A carburetor, comprising:

a metal body having an approximately horizontally extending intake air passage therein, having a downwardly facing first surface on an underside thereof, and having first and second passage sections which each have a first end that opens into said intake air passage and a second end that opens through said first surface;

a metal fuel bowl having an upwardly open fuel chamber therein; and a synthetic resin fuel trunk having an upwardly facing second surface on an upper side thereof and having a circumferential flange, said fuel trunk being disposed between said body and said fuel bowl with said second surface adjacent said first surface and with said flange fixedly secured to each of said body and said fuel bowl, said fuel trunk having a portion which is disposed within said fuel chamber, having first and second fuel wells therein which can each receive fuel from said fuel chamber, and having third and fourth passage sections which each have a first end that communicates with a respective one of said first and second fuel wells and a second end that opens through said second surface, said first and third passage sections being in communication at said second ends thereof and being respective portions of a main fuel discharge passage which extends from said first fuel well to said intake air passage, and said second and fourth passage sections being in communication at said second ends thereof and being respective portions of a low speed fuel discharge passage which extends from said second fuel well to said intake air passage;

wherein a portion of said low speed fuel passage is defined by a groove which is provided in one of said first and second surfaces, said groove being a portion of one of said second and fourth passage sections that extends away from said second end thereof.

16. A carburetor according to claim 15, wherein said first and second surfaces are pressed tightly against each other.

17. A carburetor according to claim 16, wherein said fuel bowl engages an end of said fuel trunk opposite from said second surface and presses said fuel trunk toward said body.

18. A carburetor according to claim 16, including first, second and third seals disposed between and engaging said first and second surfaces, said first seal extending around said second end of said first passage, second seal extending around second end of said third passage, and said third seal extending around each of said first and second seals, and wherein at least one of said first and second surfaces has therein a groove pattern which receives each of said first, second and third seals.

19. A carburetor according to claim 18, wherein said first, second and third seals are each an O-ring which is a respective integral portion of a single seal part.

20. A carburetor according to claim 15, including a further groove which is provided in one of said first and second surfaces and which defines a portion of a bleed air passage that carries air and communicates with said main fuel discharge passage; and including in one of said first and second surfaces an additional groove which defines a portion of a fuel supply passage that carries fuel and communicates with said fuel chamber.

* * * * *

UNITED STATES PATENT AND TRADEMARK OFFICE

CERTIFICATE OF CORRECTION

PATENT NO. : 6,435,482 B1
DATED : August 20, 2002
INVENTOR(S) : Masaaki Omi et al.

It is certified that error appears in the above-identified patent and that said Letters Patent is hereby corrected as shown below:

Column 12,
Line 5, after “between and”, delete “sealing” and insert -- sealingly --.

Signed and Sealed this

Fourteenth Day of January, 2003

JAMES E. ROGAN
*Director of the United States Patent and Trademark Office*